United States Patent [19]

Herth

[11] 4,178,883

[45] Dec. 18, 1979

[54] METHOD AND APPARATUS FOR FUEL/AIR MIXTURE ADJUSTMENT

[75] Inventor: Harro Herth, Schwieberdingen, Fed. Rep. of Germany

[73] Assignee: Robert Bosch GmbH, Stuttgart, Fed. Rep. of Germany

[21] Appl. No.: 872,140

[22] Filed: Jan. 25, 1978

[30] Foreign Application Priority Data

Jan. 25, 1977 [DE] Fed. Rep. of Germany ..... 2702863

[51] Int. Cl.[2] ..... F02B 3/08; F02M 7/12; F01N 3/08

[52] U.S. Cl. ..... 123/32 EE; 123/119 EC; 60/285; 60/276

[58] Field of Search ..... 123/32 EE, 119 EC; 60/285, 276

[56] References Cited

U.S. PATENT DOCUMENTS

| | | | |
|---|---|---|---|
| 3,911,884 | 10/1975 | Moriya et al. | 123/119 EC |
| 3,963,009 | 6/1976 | Mennesson | 123/119 EC |
| 4,022,171 | 5/1977 | Laprade et al. | 123/119 EC |
| 4,112,880 | 9/1978 | Asano et al. | 123/32 EE |

FOREIGN PATENT DOCUMENTS

| | | | |
|---|---|---|---|
| 2705227 | 8/1977 | Fed. Rep. of Germany | 123/119 EC |

*Primary Examiner*—Charles J. Myhre
*Assistant Examiner*—P. S. Lall
*Attorney, Agent, or Firm*—Edwin E. Greigg

[57] ABSTRACT

A method and apparatus for adjusting the reference or set-point value which is used in a closed-loop fuel control system for comparison with the actual value signal from an exhaust gas analyzer or sensor. The frequency of amplitude alternations of the sensor signal is a measure of engine speed and gas throughput rate. Accordingly, the invention provides generation of a quasi-D.C. signal whose amplitude is related to the frequency of sensor signal alternations. This signal is then used to change the supply voltage for a voltage-dividing circuit that supplies the reference voltage to the comparator circuit. The invention describes continuous and discrete adjustments of the reference signal.

8 Claims, 6 Drawing Figures

METHOD AND APPARATUS FOR FUEL/AIR MIXTURE ADJUSTMENT

BACKGROUND OF THE INVENTION

The invention relates to the fuel management of internal combustion engines. More particularly, the invention relates to the fuel supply systems of internal combustion engines in which the exhaust gas chemistry or composition is continuously monitored by at least one oxygen sensor whose signal is employed to engage a closed-loop control system for adjusting the fuel-air ratio of the combustible mixture supplied to the engine. The fuel supply system itself may be a carburetor or an electrical fuel injection system and the invention will be particularly useful in engines which employ a catalyzer for post combustion of fuel gases in the exhaust. The fuel control system to which this invention particularly relates would normally include a comparator that serves to compare the output signal from the oxygen sensor with a locally generated setpoint or reference value and the comparator output might be coupled into an integrating circuit for forming a fuel valve control signal, for example, or a signal used to adjust the fuel-air mixture in some other way. The fuel supply system may introduce the fuel continuously or intermittently into the induction manifold of the engine. When closed-loop control is used in this manner, the engine itself with its induction and exhaust manifolds becomes the controlled system while the fuel preparation system is the controller. It is well known that the oxygen sensor, also sometimes called λ-sensor, which is normally located in the exhaust system of the engine, generates an abruptly changing output signal in dependence on the presence or absence of excess oxygen, i.e., depending on whether the original mixture fed to the engine is lean or rich. The comparator circuit then performs an electrical comparison of the output sensor voltage with a threshold or set-point signal and alters its own output in dependence on which of the two signals is smaller. The known control system thus permits a very exact continuous adjustment of the mixture to an air factor $\lambda=1$, i.e. a stoichiometric mixture. One disadvantage of the aforementioned system is that the air factor λ based on the set-point value supplied to the comparator will remain constant for all operational states of the engine. It is a demonstrated fact, however, that the chemical composition of the exhaust is a function of engine load for example, so that it might be advantageous to be able to shift operation of the engine to an air factor λ which is variable within a very narrow range depending on engine load, for example. This is especially desirable if the engine is equipped with a catalyzer which itself has a very steep characteristic curve and must thus be operated at the precise stoichiometric point. However, the characteristic curve of the catalyzer can also be subject to shifts due to engine load which are then accounted for by the change in the set-point value fed to the comparator.

OBJECT AND SUMMARY OF THE INVENTION

It is thus a principal object of the present invention to provide a method and associated apparatus for permitting the continuous and automatic change of the λ-sensor set-point signal within narrow limits. It is a further object of the invention to perform the change in the set-point value in dependence on engine load. These and other objects are attained according to the invention by providing an electronic circuit which monitors the frequency of change in the λ-sensor output signal or the associated comparator signal and employs it to change the set-point value accordingly. Thus the method and apparatus of the invention permit changing the reference or set-point signal for the air factor λ very precisely around a narrow region to either side of the stoichiometric value $\lambda=1$ in dependence on engine load. This invention is based on the recognition that the switching frequency of the λ-sensor signal is a function of engine load so that no external transducers are required to monitor the prevailing engine load.

It is a further object of the invention to generate a quasi-D.C. signal whose amplitude is related to engine load. The presence of this signal then permits an additional shift of the air factor λ for the purpose of full-load enrichment.

The invention will be better understood as well as further objects and advantages thereof become more apparent from the ensuing detailed description of three preferred embodiments taken in conjunction with the drawing.

DESCRIPTION OF THE PREFERRED EMBODIMENTS

It is known in the prior art to employ an oxygen sensor, i.e. a so-called λ-sensor, in the exhaust system of an engine and to compare its output signal with a reference value. In the known systems, the comparison is performed by an electrical comparator whose output signal is a rectangular curve, i.e. a signal which alternates between high and low voltage. This signal is fed to further processor circuits within the fuel mixture preparation system in the sense of an overall closed-loop control. The λ-sensor signal is thus the actual control value and the fuel mixture is altered in order to maintain this control value at or near the reference value. It is also known that the output signal from the sensor undergoes a rapid shift when the air factor λ is equal to unity, i.e. when the mixture itself is stoichiometric. In particular, the λ output voltage is relatively elevated when the air factor λ is less than 1 and it is relatively low when the air factor λ is greater than 1. While the output of the λ-sensor changes very abruptly at the stoichiometric point, the change is nevertheless of finite slope as illustrated for example in FIG. 1. It is thus possible to operate the system at intermediate values between the upper and lower limits of the output of the sensor voltage if sufficiently sensitive comparators are used. The range of air factors λ within which this control may take place can be approximately 2 percent in width. A shift of the operational point within this range can be of great importance in achieving improved exhaust chemistry especially when selective catalyzers or after burners are used in the engine.

Figure 1:
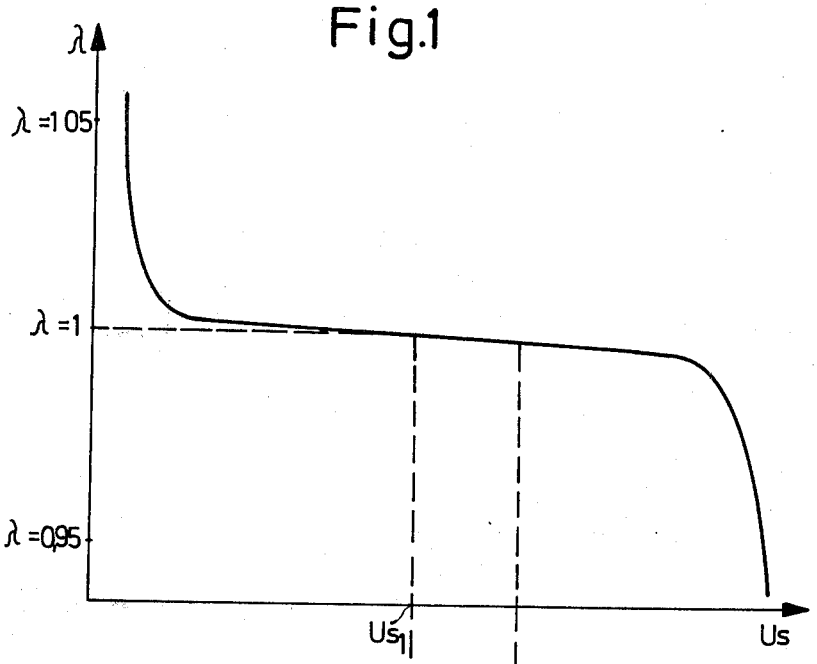
FIG. 1 is a diagram illustrating the output voltage from a known oxygen sensor as a function of air factor λ.
Figure 2:
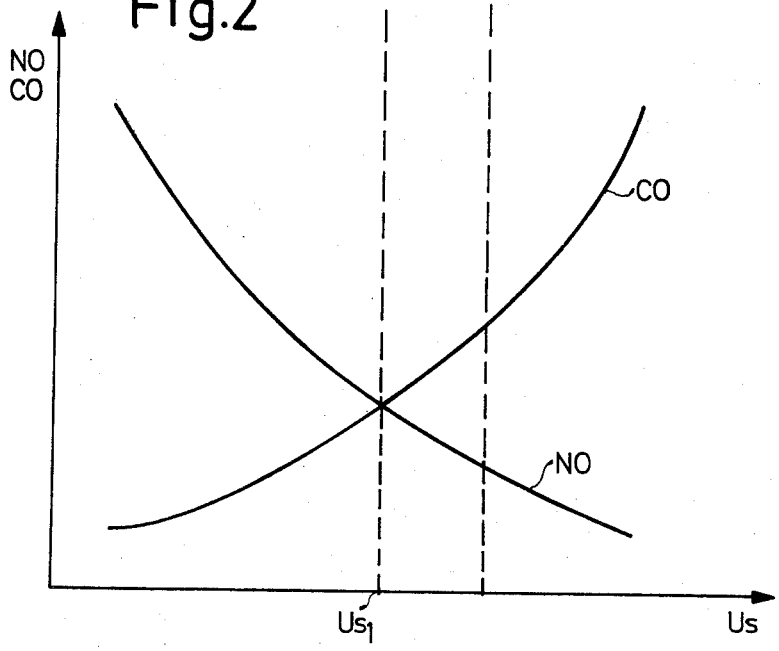
FIG. 2 is a diagram illustrating the concentration of exhaust gas components CO and NO in a λ-controlled engine with catalyzer.

FIG. 2, which is related to FIG. 1, illustrates the composition of the exhaust gas components CO and $NO_x$ as obtained in a test in which an engine was operated with λ-control and catalyzer. The concentration of these substances is plotted as a function of the sensor output voltage $U_s$. It will be appreciated that if the comparator threshold, i.e. the reference value, is fixed, for example at the value $U_{s1}$ in FIG. 1, such a fixed value will always represent a certain compromise between the lowest concentrations of CO and $NO_x$. When the exhaust chemistry is studied exactly it will be found that the concentration of $NO_x$ decreases at a greater than proportional rate with increasing engine load and speed. Therefore, while it is generally true that a catalyzer will perform optimally at the stoichiometric point, it is nevertheless the case that when the engine is heavily loaded, the most favorable compromise will be to operate it at a λ-factor slightly less than unity. In particular, this may imply actually operating the engine with a reference voltage $U_s$ of, for example, 650 mV when the engine is heavily loaded so as to obtain the most favorable exhaust gas emissions and the optimal operation of the catalyzer. At low load and low engine speed, the best compromise may be obtained, for example, at a reference value of 350 mV. The basic and principal idea of the present invention is thus to alter the reference voltage $U_s$ in dependence on the prevailing load state of the engine, i.e. its gas throughput. An associated circumstance of this consideration is the fact that the very steep characteristic curve of the catalyzer itself also undergoes a slight shift as a function of engine load which is also equalized by the reference adjustment according to the present invention and thus simultaneously insures the optimum operation of the catalyzer at all engine load states. However, the method for changing the sensor reference is not limited to being used in engines having catalyzers but can be used wherever the sensor threshold voltage can advantageously be adjusted within very narrow limits and in sensitive manner for any purpose.

Figure 3:
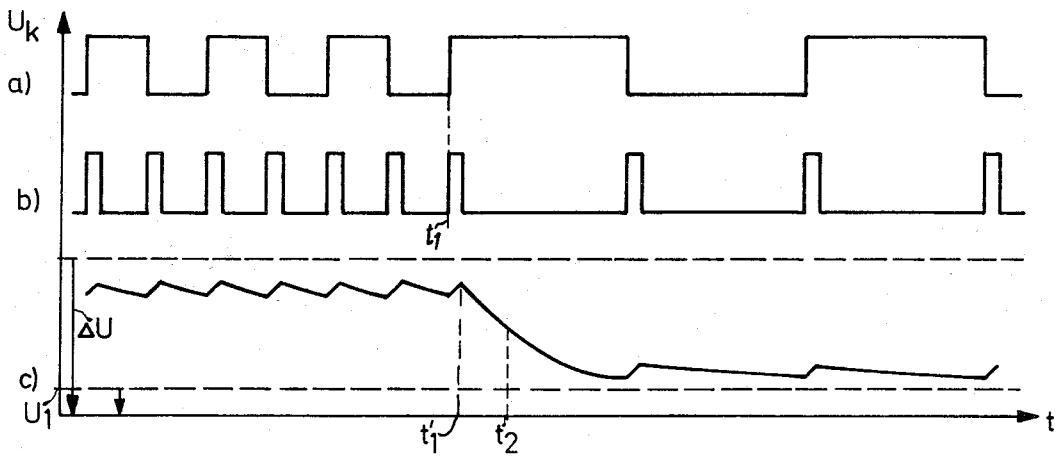
FIG. 3 is a diagram illustrating various voltages generated by the circuit according to the invention.

By placing the exact reference voltage $U_s$ at some point of the steeply increasing sensor voltage curve, it is possible to operate the engine at any intermediate air factor, i.e. at any ratio of air-to-fuel within the prescribed limits. The output signal from the subsequent comparator will be high or low and will generally resemble a rectangular voltage such as illustrated in FIG. 3*a*. It has also been found by experiment that the time elapsing between two zero-passages of the comparator output voltage $U_K$, i.e. the switching frequency of the comparator, depends strongly on the gas throughput of the engine. The reason for this fact is that the dead time of the engine is a factor in the total time between two zero passages of the comparator output because, if the rate of mass flow of gases through the engine, henceforth called throughput, is higher, the λ-sensor will recognize this change taking place at the induction manifold more quickly and is thus able to respond faster. The overall control system operates on the principle of a two-point controller and the switching frequency of the comparator output voltage is thus a very general measure of engine load. When the engine throughput and load are great, the switching frequency will be high and when the engine load is low, the switching frequency will also be low. These events are illustrated in FIG. 3*a* where the first half of the curve illustrates high load whereas, beginning approximately with the time $t_1$, there is shown a relatively low load and low switching frequency.

It is a significant feature of the present invention that the adjustment, i.e. the automatic correction, of the reference voltage which is to be compared with the sensor output voltage is based on the frequency of occurrence of alternations in the comparator output signal which, as already explained, is dependent on the gas throughput time through the engine. In a first preferred exemplary embodiment of the invention, the comparator output signal is transformed into a voltage whose amplitude is proportional to engine throughput and it is this voltage which is then used to shift the comparator threshold. In a further preferred and advantageous embodiment, the same throughput-proportional voltage is used as a control signal for a so-called dynamic λ shift which will be explained in greater detail below.

Figure 4:
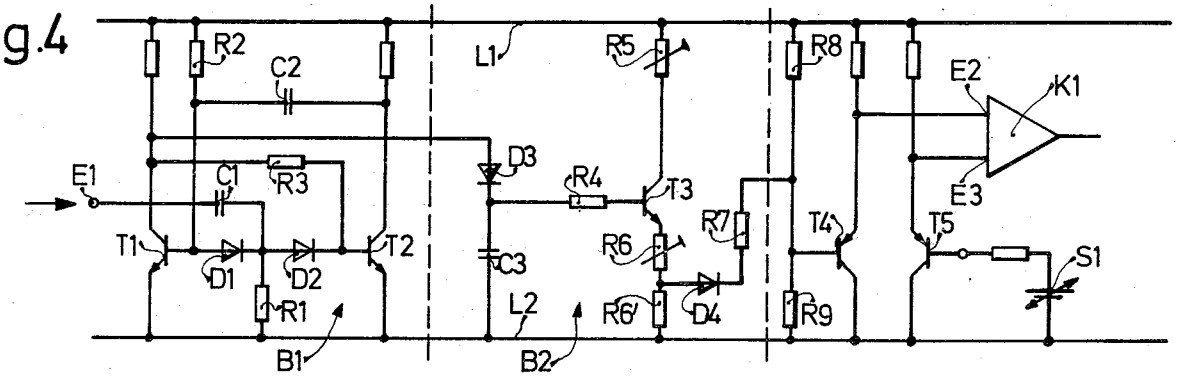
FIG. 4 is a detailed circuit diagram of a first exemplary embodiment of a circuit according to the invention for load-dependent set-point adjustment.

FIG. 4 is a circuit diagram of a first embodiment of a circuit according to the invention. The purpose of this circuit, as already mentioned, is to monitor the frequency of occurrence of the comparator signal shifts and to produce therefrom a quasi-D.C. voltage whose amplitude is load-dependent. The input circuitry for the comparator is illustrated in simplified manner and serves to produce a reference signal which can be adjusted in very sensitive fashion by the circuit according to the invention.

The first embodiment according to FIG. 4 includes a possibly integrated circuit B1 which transforms the frequency of occurrence of the λ-output signal alternations or that of the comparator voltage into a pulse train having a constant pulse width but variable frequency as illustrated in FIG. 3*b*. This transformation is accomplished by a monostable multivibrator consisting of transistors T1 and T2 which receive at their input the signal from the output of the comparator at a point E1 via a capacitor C1. The capacitor C1 serves to differentiate the rectangular signal of the comparator through the resistor R1 connected to ground L2 and the positive or negative spike travels through appropriately connected diodes D1 and D2 to the bases of transistors T1 and T2 so that the monostable multivibrator of the circuit B1 is triggered with each edge of the signal and then runs at a time constant equal to the product R2·C2. The monostable multivibrator B1 may be a known circuit element and its detailed construction need not be further discussed. In the normal case, i.e. in the stable state of the multivibrator, the transistor T1 conducts and maintains the base of the transistor T2 at a sufficiently negative voltage to block the transistor T2. A negative spike at the input E1 travels through the diode D1 and blocks the transistor T1 so that the monostable multivibrator assumes its metastable state in which the collector of the blocked transistor T1 has positive voltage. After the expiration of the time constant of the multivibrator, which is always kept smaller than the shortest half period of the triggering input signal, the transistor T1 returns to its conducting state. A positive spike is conducted through the diode D2 to the base of the transistor T2 which then conducts and forces the transistor T1 into its blocked state via the coupling capacitor C2 which also determines the time constant of the multivibrator. Accordingly, the output of the multivibrator circuit B1 at the collector of the transistor T1 will be a pulse train as illustrated in FIG. 3*b* and this pulse train is transmitted via the diode D3 to a capacitor C3 causing the latter to be charged to a positive potential of varying magnitude. The charging process takes place at low impedance via the diode D3. When the monostable multivibrator B1 is in its stable state, the diode D3 blocks and the capacitor C3 now discharges through a resistor R4 and the base-emitter path of the transistor T3 which is controlled by the voltage at the capacitor C3. Accordingly, the emitter of the transistor T3 carries the voltage at the capacitor C3. The collector of the transistor T3 is connected through an adjustable resistor R5 to the positive supply line L1 and its emitter is connected through at least one resistor R6, R6' to the negative supply line L2. The transistor T3 and its associated circuit elements constitute an integrator B2 which integrates the output pulse train of the monostable multivibrator B1 and which acts via the diode D4 and the resistor R7 to raise the threshold or reference voltage for the comparator which is formed in this case with the aid of a voltage divider consisting of resistors R8 and R9. The threshold or reference voltage is then transmitted via a transistor T4 to one input E2 of the comparator K1 while the second input E3 of the comparator receives the abruptly changing signal of the λ-sensor S1 via an impedance-converting transistor T5. It is to be noted that the circuitry coupling the λ-sensor to the comparator is shown in simplified fashion for purposes of clarification.

The voltage at the emitter of the transistor T3, i.e. of the integrating circuit B2, is shown in FIG. 3*c* where it will be seen that when the triggering signal 3B occurs at relatively high frequency, which again corresponds to heavy engine loading and high rpm, the amplitude of the integrator output signal is relatively high and thus shifts the voltage across the voltage divider R8, R9 to thereby exert a strong influence on the level of the reference voltage applied to the comparator. This causes a relatively high increase of the threshold voltage within the maximum possible range while, when a lower threshold U1 is reached, the voltage at the emitter of the transistor T3 falls below the divided voltage of the voltage divider R8, R9 and thus blocks the diode D4 causing the threshold adjustment to become ineffective. The distance marked ΔU is the maximum change in the amplitude of the output signal of the integrator. It will be appreciated that the circuit illustrated in FIG. 4 may assume any intermediate value depending on the rapidity of occurrence of voltage shifts in the sensor output signal, which in turn depends on the status of the engine.

Figure 5:
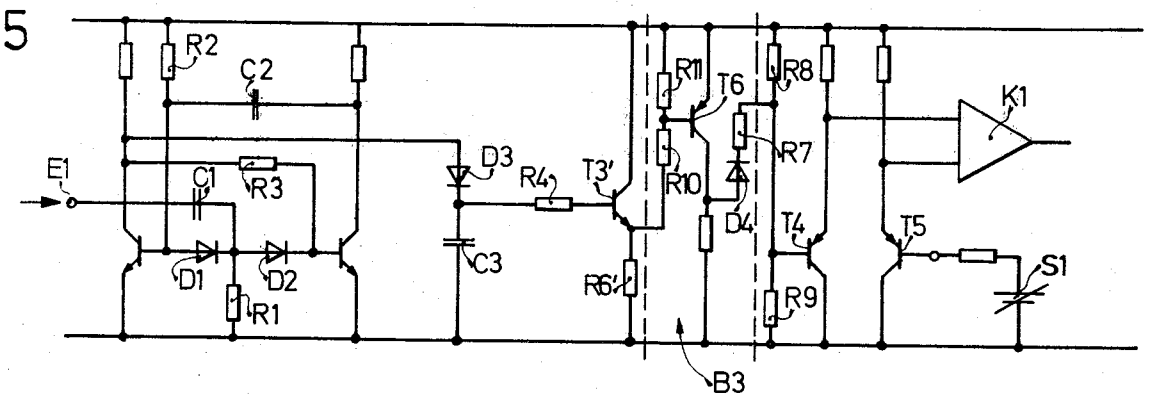
FIG. 5 illustrates a second exemplary embodiment of the invention with discontinuous change in the set-point value.

A second exemplary embodiment of the invention illustrated in FIG. 5 permits a two-point threshold switching in dependence on engine load. The circuit of FIG. 5 is substantially similar to that of FIG. 4 except for the inclusion of an additional circuit block B3. The quasi-D.C. voltage present at the emitter of the transistor T3 and illustrated in FIG. 3*c*, which may be modulated to a small degree at the frequency of comparator signals, is fed through a voltage divider R10 and R11 to the base of a transistor T6 from whose collector there is taken a voltage which switches the voltage divider R8, R9 between two definite voltage regions. Depending on the dimensions and characteristics of the electrical elements and especially the magnitude of the base voltage divider circuit including resistors R11, R10 and R6', one may ensure that the transistor T6 either conducts or blocks so that two definite threshold values may be applied to the reference input of the comparator K1. One of these definite threshold values may be related to a relatively low engine load and may have a value, for example, of 400 mV while the second threshold or reference value may be suitable for relatively high engine loading and may be equal to, for example, 600 mV. The switchover from one to the other regions may take place at some average output voltage of the transistor T3', for example at the time $t_2$.

Figure 6:
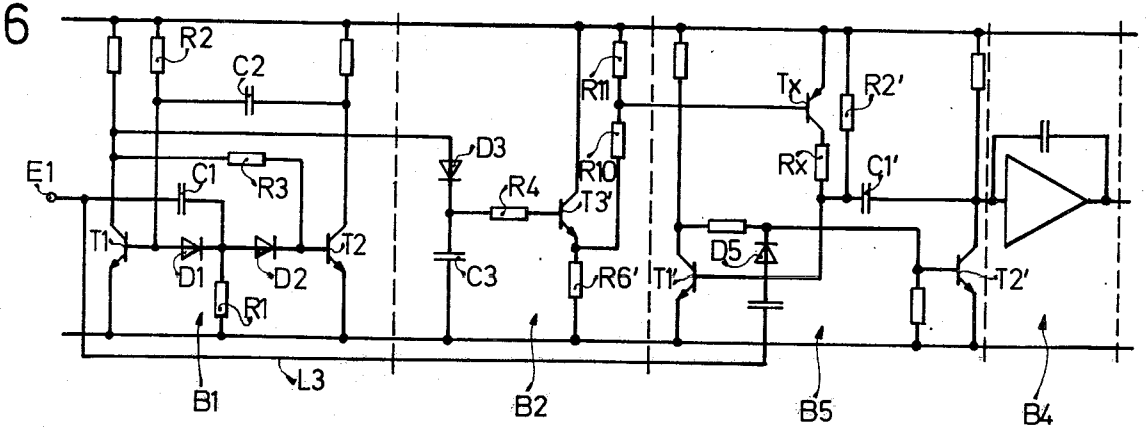
FIG. 6 illustrates a third embodiment of the invention including a dynamic change of the λ point during full-load enrichment.

In a third embodiment and further refinement of the present invention, the circuit may also be used for a dynamic shift of the value of the air factor λ at which the engine is operated to a value which is substantially outside of the normal control range. A deliberate full-load enrichment of this type serves to permit the engine to deliver maximum power. Such an enrichment may be obtained by causing the integrator circuit B4 in FIG. 6 to continue to integrate in the direction of a rich mixture even after the λ-sensor has already switched over. If this effect takes place at each and every switchover of the λ-signal, the overall result will be an increase of the output signal from the integrator which tends to cause the mixture preparation system to deliver a richer mixture. The frequency of λ-sensor shifts being a measure for engine loading, one may use the quasi-D.C. voltage occurring at the emitter of the transistor T3 or at the emitter of the transistor T3' in FIG. 6 as a measure for the full-load operation of the engine. For this purpose, the circuit block B1 of FIG. 6 and the circuit block B2 connected to it permit this full-load λ shift by using the output signal from the transistor T3' for changing the time constant of a monostable multivibrator which then causes the delayed actuation of the subsequent integrator B4. The first integrator circuit B2 includes a voltage divider chain consisting of resistors R11, R10 and R6', the junction of the latter two being connected to the emitter of the transistor T3'. The voltage taken from the junction of the resistors R11 and R10 is fed to the base of a transistor Tx which blocks when the engine operates at full-load and the frequency of sensor alternations is high. The transistor Tx is connected in series with a low-valued discharge resistor Rx, both being parallel to a discharge resistor R2' which is part of a further monostable multivibrator B5 that performs the unilateral delayed actuation of the integrator B4. Except for the fact that the discharging path for the timing capacitor C1' has a high impedance and a low impedance path that can be switched into operation alternately, the circuit B5 is substantially similar to the previously discussed monostable multivibrator B1 and will not be treated in great detail. The multivibrator B5 is triggered by one edge of the comparator output signal, i.e. the positive-going edge, which is transmitted via the line L3 and a diode D5. Accordingly, when the sensor output voltage changes in one direction, the monostable multivibrator B5 performs a delay in the actuation of the integrator B4, the magnitude of the delay being defined by the values of the timing components of the multivibrator.

The function of the last described circuit is such that the throughput or load-dependent voltage present at the emitter of the transistor T3' controls the transistor Tx in such a way that when the emitter voltage at the transistor T3' is low, corresponding to low engine loading, the transistor Tx is conducting, thereby causing the low impedance discharge path Rx to be connected in parallel with the discharge resistor R2'. This causes the time constant of the monostable multivibrator B5 to be short so that its delay is insignificant and the actuation signal for the integrator B4 is transmitted virtually without delay. If however the voltage at the emitter of the transistor T3' exceeds the switching voltage of the transistor T6, which would correspond to full engine load, the latter blocks and the monostable multivibrator operates at a desired delay whose time constant $\tau = R2' \cdot C1'$. In that case, the actuation signal for the integrator B4 is transmitted from the output of the comparator with a constant and adjustable delay, thereby serving to produce the mixture enrichment in the sense described above. This happens because, during the delay, the integrator B4 continues to integrate in the direction of fuel mixture enrichment. The signal present at the emitter of the transistor T3 or T3' whose amplitude is proportional to or related to the throughput and load of the engine may, of course, also be used for other purposes, for example for fuel mixture leaning or any other control purposes.

The foregoing relates to preferred exemplary embodiments of the invention, it being understood that other embodiments and variants thereof are possible within the spirit and scope of the invention.

What is claimed and desired to be secured by Letters Patent of the United States is:

1. A method for adjusting the operating point of a fuel mixture control system of an internal combustion engine, said mixture control system including a fuel mixture generator, an exhaust gas sensor for providing an actual value signal and a set-point signal generator, said actual valve signal and said set-point signal being compared in a comparator circuit which generates a comparator signal which is used by a final control element within said fuel mixture generator and wherein the improvement comprises the steps of:

(a) generating a correction signal which contains information related to the frequency of amplitude alternations in the actual value signal provided by said exhaust gas sensor; and (b) applying said correction signal to an input of said comparator to thereby adjust said set-point signal; whereby, when the engine load changes, the fuel-mixture ratio is changed from a first value to at least one second value distinct from said first value.

2. A method as defined by claim 1, for application to an internal combustion engine which includes an exhaust gas catalyzer for reducing the concentration of toxic exhaust gas components.

3. A method as defined by claim 1, wherein said step of adjusting the set-point signal includes a measurement of the time elapsing between two zero crossings of said comparator signal and further includes generating from said measurement a D.C. signal which is dependent on the rate of mass flow through said engine and on engine speed, said D.C. signal being applied to said set-point generator, thereby causing the adjustment of said set-point signal.

4. An apparatus for adjusting the operating point of a fuel mixture control system of an internal combustion engine, said mixture control system including a fuel mixture generator, an exhaust gas sensor for providing an actual value signal and a set-point signal generator, said actual value signal and said set-point signal being compared in a comparator circuit which generates a comparator signal which is used by a final control element within said fuel mixture generator and wherein the improvement comprises:

a pulse generator for generating an electrical pulse whenever said comparator signal crosses the zero voltage level;

an integrator for integrating said electrical pulses from said pulse generator, the output from said integrator being fed to said set-point generator; whereby the set-point signal is adjusted in dependence on the rate of mass flow through said engine.

5. An apparatus as defined by claim 4, wherein said pulse generator includes a monostable multivibrator for receiving the comparator output signal and for generating a train of pulses having constant width and variable frequency, and wherein the improvement further comprises a transistor (T3) connected as an emitter-follower to which the output from said integrator is applied, and a voltage divider circuit (R8, R9) connected to the emitter of said transistor (T3), said voltage divider circuit being connected to said set-point generator; whereby the value of said set-point signal is adjusted.

6. An apparatus as defined by claim 5, wherein said monostable multivibrator includes associated transistors (T1, T2) the bases of which receive said comparator output signal via respective diodes (D1, D2), and wherein said comparator is connected via a diode to a capacitor in said integrator circuit; whereby said capacitor receives a pulse at each zero crossing of said comparator output signal.

7. An apparatus as defined by claim 4, further comprising a monostable multivibrator (T1, T2), for receiving said comparator output signal and for generating an output pulse train, and further comprising a voltage divider circuit (R10, R11, R6'), and connected thereto a transistor (T3'), controlled by said monostable multivibrator, and a switching transistor (T6), connected to said voltage divider circuit, said transistor (T6) being connected to said set-point generator; whereby said set-point generator provides two distinct set-point signals depending on the switching state of said monostable multivibrator.

8. An apparatus as defined by claim 4, further comprising a monostable multivibrator (T1, T2), triggered by said comparator output signal for generating a pulse train of constant pulse width and variable frequency, and wherein said apparatus further comprises a transistor (T3'), controlled by said monostable multivibrator, and a voltage divider circuit connected to said transistor (T3'), a switching transistor (Tx), connected to said voltage divider circuit (R10, R11), a resistor (Rx) connected in series with said switching transistor (Tx) and a second monostable multivibrator (T1', T2'), including a timing capacitor (C1'), connected to said resistor (Rx); whereby, when the gas throughput rate of said internal combustion engine is low, and the frequency of zero crossings of said comparator signal is low, the time constant of said second monostable multivibrator is short, whereas when the frequency of zero crossings of said comparator signal is high, the time constant of said second multivibrator is high, thereby delaying the transmission of said comparator signal by a finite time.

* * * * *